US007731768B2

(12) United States Patent
Oldfield et al.

(10) Patent No.: US 7,731,768 B2
(45) Date of Patent: Jun. 8, 2010

(54) DIESEL FUEL EMULSION

(75) Inventors: Andrew Simon Oldfield, Saltburn by Sea (GB); Lee Thompson, Trimdon Grange (GB)

(73) Assignee: Croda International PLC, Goole, East Yorkshire (GB)

( * ) Notice: Subject to any disclaimer, the term of this patent is extended or adjusted under 35 U.S.C. 154(b) by 1095 days.

(21) Appl. No.: 10/491,991

(22) PCT Filed: Sep. 19, 2002

(86) PCT No.: PCT/GB02/04254

§ 371 (c)(1),
(2), (4) Date: Nov. 8, 2004

(87) PCT Pub. No.: WO03/031540

PCT Pub. Date: Apr. 17, 2003

(65) Prior Publication Data

US 2005/0060928 A1 Mar. 24, 2005

(30) Foreign Application Priority Data

Oct. 8, 2001 (GB) ..... 0124117.3

(51) Int. Cl.
*C10L 1/32* (2006.01)
*C10L 1/19* (2006.01)

(52) U.S. Cl. ..... 44/302; 44/301; 44/389; 44/447

(58) Field of Classification Search ..... 44/301, 44/302

See application file for complete search history.

(56) References Cited

U.S. PATENT DOCUMENTS

| | | | | |
|---|---|---|---|---|
| 5,133,898 | A * | 7/1992 | Fock et al. | 516/30 |
| 5,338,485 | A * | 8/1994 | Fock et al. | 516/29 |
| 6,068,670 | A * | 5/2000 | Haupais et al. | 44/301 |
| 6,284,806 | B1 * | 9/2001 | Chakrabarty et al. | 516/77 |
| 6,677,388 | B2 * | 1/2004 | Chakrabarty et al. | 516/77 |
| 6,733,549 | B2 * | 5/2004 | Huffer et al. | 44/301 |
| 6,997,964 | B1 * | 2/2006 | Marelli | 44/301 |
| 7,018,433 | B2 * | 3/2006 | Rivolta et al. | 44/301 |
| 7,041,145 | B2 * | 5/2006 | Ambrosini et al. | 44/301 |
| 7,276,093 | B1 * | 10/2007 | Rivas et al. | 44/301 |

* cited by examiner

*Primary Examiner*—Ellen M McAvoy
(74) *Attorney, Agent, or Firm*—Jones Day

(57) ABSTRACT

A fuel emulsion consists of diesel, water and an emulsifier composition having a hydrophile/lipophile balance value of at least 4. The emulsifier composition comprises a polymeric non-ionic surfactant having hydrophilic and hydrophobic repeating units together with at least one component selected from fatty acid esters or partial esters of polyhydric alcohols; alkoxylated fatty acid esters or partial esters of polyhydric alcohols; and alkoxylated primary alcohols. Preferred emulsifier compositions according to the invention include mixtures of the polymeric non-ionic surfactant with at least two of the components. Especially preferred compositions comprise mixtures of the polymeric non-ionic surfactant with the fatty acid (partial) esters or alkoxylated fatty acid (partial) esters. The emulsifier composition may include an emulsion coupler such as a primary alcohol, e.g. octanol.

39 Claims, No Drawings

DIESEL FUEL EMULSION

CROSS REFERENCE TO RELATED APPLICATION

This application is the National Phase application of International Application No. PCT/GB02/04254, filed Sep. 19, 2002, which was published in English and designates the United States. This application, in its entirety, is incorporated herein by reference.

The invention relates to fuel emulsions and to emulsifier compositions for use therein.

Diesel engines are used in a wide variety of applications including automotive, marine, electricity generation and compressors. Such engines are often relatively inefficient and emit significant quantities of pollutant gases and particles. This is of particular concern when the engines are in public service vehicles such as buses and the resultant pollution affects significant numbers of people in town centres.

To increase the efficiency with which the diesel fuel is burnt in such engines and to reduce the generation of pollutants, water is added to the diesel to form an emulsion therewith. Typically, such emulsions contain at least 80% by weight diesel and up to 15% by weight of water (the weight percentages being based on the total weight of the composition). As water and oils such as diesel do not naturally mix, it is necessary to use emulsifiers in the water/diesel mixture to aid the formation and retention of emulsions. The emulsifiers are typically present in amounts up to 6% by weight based on the total weight of the composition.

Diesel fuels also typically include additives for various purposes. For example, such fuels may contain cetane number improvers, eg nitrates, nitro and nitroso compounds and peroxides, at levels of up to 0.3% by weight. Dispersants and detergents, for example low molecular weight amines, are used to improve engine cleanliness. To improve the low temperature properties of the fuel, cold flow blending agents, eg kerosene, may be added in quantities up to several percent to dilute the formation of wax crystals. Additionally, cold flow additives, eg ethylene-vinyl ester copolymers, chlorinated hydrocarbons and polyolefins, may be used at ppm levels to alter the formation of wax crystals.

Other additives may include oxygenates, eg rapeseed oil methyl ester, to improve fuel combustion characteristics; antioxidants, eg amines and other nitrogen-containing compounds, to improve the long term stability of the fuel with respect to colour and sediment formation; lubricity aids and metal deactivators.

Owing to the shelf life requirement for such water/diesel fuel emulsions (from blending to use in an engine), a primary requirement for the emulsions is that they are stable for a minimum period, ie 10,000 minutes (1 week). Another primary requirement for the fuel emulsions is that they are competitively priced in the relevant markets; consequently, any additives such as emulsifiers need to be used in minimum amounts and/or be as inexpensive as possible.

Current water/diesel fuel formulations use simple, low-cost emulsifiers such as partial esters of polyhydric alcohols at relatively high levels, eg 4% to 6% by weight. However, such emulsifiers at those levels may result in deposits being formed within engines leading to greater inefficiency of operation.

Known water/diesel fuel formulations are disclosed in WO 85/04183 A1, WO 00/63322 A1, WO 01/02516 A1, U.S. Pat. No. 3,876,391, GB-A-2066288, GB-A-2352246, EP-B1-0012292, EP-B1-0242832, EP-B1-0372353, EP-B1-0888421, EP-A1-0893488, EP-A2-1101815, DE-A-3229918, CN 1079499 and JP-B2-2793190.

It is an object of the present invention to provide a stable, cost-effective fuel emulsion and emulsifier compositions for use in fuel emulsions.

According to the present invention, a fuel emulsion comprises a water-in-diesel emulsion containing an emulsifier composition in an amount effective to form a stable emulsion, the emulsifier composition comprising a polymeric non-ionic surfactant having hydrophilic and hydrophobic repeating units together with at least one component selected from:— a) fatty acid esters or partial esters of polyhydric alcohols;
b) alkoxylated fatty acid esters or partial esters of polyhydric alcohols; and
c) alkoxylated primary alcohols;

the polymeric non-ionic surfactant and said at least one component being selected such that the emulsifier composition has an hydrophile/lipophile balance value of at least 4 and, more preferably at least 5.

The hydrophile/lipophile balance (HLB) of surfactants is described in Preservation of Surfactant Formulations, Ed F F Morpeth, Published by Blackie Academic & Professional, 1995, Ch 4, Section 4.5, p 77 et al.

The invention also includes an emulsifier composition for use in fuel emulsions, which composition comprises a polymeric non-ionic surfactant having hydrophilic and hydrophobic repeating units together with at least one component selected from:— a) fatty acid esters or partial esters of polyhydric alcohols;
b) alkoxylated fatty acid esters or partial esters of polyhydric alcohols; and
c) alkoxylated primary alcohols;

the polymeric non-ionic surfactant and said at leas one component being selected such that the emulsifier composition has an hydrophile/lipophile balance value of at least 4 and, more preferably at least 5.

Preferred emulsifier compositions according to the invention have an hydrophile/lipophile balance value of not more than 8 and, more preferably not more than 7 and more especially not more than 6.

Preferably, the fuel emulsion according to the invention contains at least 70% by weight diesel and up to 25%, more particularly around 10% to 20%, by weight of water, the weight percentages being based on the total weight of the emulsion.

The fuel emulsion may also contain conventional additives as previously discussed.

Preferably, the fuel emulsion comprises an amount of emulsifier composition in the range 0.1% to 4% by weight of the total weight of the composition; more preferably, an amount of emulsifier composition in the range 1% to 3% by weight; and especially an amount in the range 1% to 2.5% by weight.

Preferably, the polymeric non-ionic surfactant has an HLB of between 4 and 13, more preferably between 4 and 8. The polymeric non-ionic surfactant is preferably a polyester. Preferably, the hydrophilic units are polyoxyalkylene units, especially polyoxyethylene units; and the hydrophobic units are long chain hydrocarbon residues. Suitable polymeric non-ionic surfactants of this type are available from Uniqema under the trade mark Hypermer (Hypermer is a trade mark owned by the ICI group of companies).

Preferably, component a) is the reaction product of one or more polyhydric alcohols and one or more fatty acids. The ester reaction products may be monoesters or di-, tri- or higher esters or partial esters or mixtures thereof.

More particularly, the polyhydric alcohols comprise glycols, ie dihydric alcohols, and higher alcohols such as glycerol, sorbitol and neopentyl alcohols such as trimethylol propane, pentaerythritol, neopentyl glycol and oligomers thereof such as di-trimethylol propane, tri-trimethylol propane, di-pentaerythritol and tri-pentaerythritol and mixtures of two or more thereof. More especially, the polyhydric alcohols comprise alcohols having at least three hydroxyl groups such as glycerol and sorbitol and preferably are sorbitol.

The fatty acid comprises a $C_{12}$ to $C_{24}$, straight or branched chain, saturated or unsaturated acid such as myristic, palmitic; isopalmitic, stearic, isostearic, oleic and linoleic acids or mixtures thereof. More especially, the fatty acid comprises a $C_{16}$ to $C_{20}$ straight chain acid such as stearic or oleic acid and preferably it is oleic acid.

Examples of component a) are sorbitan monolaurate, sorbitan monopalmilate, sorbitan monosterate, sorbitan tristerate; sorbitan sesquioleate, sorbitan monooleate and sorbitan trioleate. Suitable esters of this type are available from Uniqema under the trade mark Span (Span is a trade mark owned by the ICI group of companies).

Preferably, component b) is the reaction product of at least one component a) ester with an alkylene oxide.

Component a) esters are preferably alkoxylated using ethylene oxide or propylene oxide; especially ethylene oxide. In particular, the esters are alkoxylated with not more than 50 moles of alkylene oxide, preferably not more than 30 moles of alkylene oxide Examples of component b) are polyoxyethylene versions of sorbitan monolaurate, sorbitan monopalmilate, sorbitan monosterate, sorbitan tristerate, sorbitan sesquioleate, sorbitan monooleate, and sorbitan trioleate. Suitable alkoxylated esters of this type are available from Uniqema under the trade mark Tween (Tween is a trade mark owned by the ICI group of companies).

Preferred component c) alkoxylated primary alcohols are derived from $C_7$-$C_{20}$, more especially from $C_9$ to $C_{15}$, primary alcohols or mixtures thereof. The primary alcohols are preferably alkoxylated using ethylene oxide or propylene oxide; especially ethylene oxide. In particular, the alcohols are alkoxylated with not more than 50 moles of alkylene oxide, preferably not more than 30 moles of alkylene oxide.

Examples of component c) are polyoxyethylene versions of $C_9/C_{11}$ and $C_{13}/C_{15}$ mixtures of primary alcohols. Suitable alkoxylated primary alcohols are available from Uniqema under the trade mark Synperonic (Synperonic is a trade mark owned by the ICI group of companies).

Other components that function as emulsion couplers may also be used in the emulsifier compositions of the invention. For example, a primary alcohol may be added to the composition. The primary alcohol may be added in amounts up to 5% by weight, more preferably up to 3% by weight of the emulsifier composition. The primary alcohol is preferably selected from $C_5$ to $C_{15}$ more especially $C_6$ to $C_{12}$, primary alcohols and is typically octanol.

Preferred emulsifier compositions according to the invention include mixtures of the polymeric non-ionic surfactant with at least two components selected from components a), b) and c). Mixtures of components a) and b) comprise especially preferred compositions of the invention.

Preferred emulsifier compositions according to the invention comprise not more than 50% by weight, based on the total weight of the emulsifier composition, more preferably between 1% and 30%, and more especially between 2.5% and 20% of the polymeric non-ionic surfactant in combination with at least one of components a), b) and c). More especially, emulsifier compositions comprise the polymeric non-ionic surfactant in combination with at least two of components a), b) and c). The most preferred emulsifier compositions comprise the polymeric non-ionic surfactant in combination with components a) and b). Preferably, the emulsifier compositions are formulated to have an HLB in the range 5 to 6.

The present invention includes a method of making a fuel emulsion which comprises a water-in-diesel emulsion containing an emulsifier composition in an amount effective to form a stable emulsion, the emulsifier composition comprising a polymeric non-ionic surfactant having hydrophilic and hydrophobic repeating units together with at least one component selected from:— a) fatty acid esters or partial esters of polyhydric alcohols;

b) alkoxylated fatty acid esters or partial esters of polyhydric alcohols; and c) alkoxylated primary alcohols;

the polymeric non-ionic surfactant and said at least one component being selected such that the emulsifier composition has an hydrophobe/lipophobe balance value of at least 4 and, more preferably at least 5, which method comprises, in a single mixing operation introducing diesel and the emulsifier composition and then water into a mixing vessel whilst subjecting the mixture to high shear mixing at a speed and for a period sufficient to create the emulsions The invention will now be described further by way of example only with reference to the following Examples.

EXAMPLE 1

Samples of emulsifier compositions were prepared by mixing, in a beaker, specific amounts of a polymeric non-ionic surfactant and components a) and b) as defined above. The components used in the emulsifier compositions are identified in Table 1 below and the compositions themselves are identified in Table 2 below.

Samples of fuel emulsions were prepared by adding the emulsifier composition samples identified in Table 2 together with a diesel fuel, available from Petroplus, into a Turrax mixer operating on setting 1 (11,000 rpm). Demineralised water was then added slowly. The samples were mixed for a further 20 minutes after completion of water addition. A proportion of each sample was transferred to a 100 ml crow measuring cylinder, which was filled to the 100 ml mark, to stand under observation to determine the stability of the samples.

The samples of fuel emulsions are identified in Table 3 below and the results of the observations are detailed in Table 4 below.

TABLE 1

| Emulsifier Composition Components | HLB | Description |
|---|---|---|
| Polymeric Surfactant | | |
| Hypermer A60* | 6.0 | Polyester non-ionic surfactant available from Uniqema |
| Hypermer A70* | 6.0 | Polyester non-ionic surfactant available from Uniqema. This product is a direct replacement for Hypermer A60 surfactant. |
| Component a) | | |
| Span 80* | 4.3 | Sorbitan monooleate available from Uniqema |
| Span 85* | 1.8 | Sorbitan trioleate available from Uniqema |
| Component b) | | |
| Tween 85* | 11.0 | POE (20) sorbitan trioleate available from Uniqema |

*Trade marks owned by the ICI group of companies.

TABLE 2

| Emulsifier Compositions | | | | | |
|---|---|---|---|---|---|
| Sample | Span 80 % wt | Span 85 % wt | Tween 85 % wt | Hypermer A60 % wt | HLB |
| EC1 | 95 | | | 5 | 4.4 |
| EC2 | 90 | | | 10 | 4.5 |
| EC3 | 80 | | | 20 | 4.6 |
| EC4 | 60 | | | 40 | 5.0 |
| EC4a | 58.8 | | | 41.2 | 5.0 |
| EC5 | | | 10 | 90 | 6.5 |
| EC6 | | | 20 | 80 | 7.0 |
| EC7 | | | 30 | 70 | 7.5 |
| EC8 | | | 40 | 60 | 8.0 |
| EC9 | 76.5 | | 13.5 | 10 | 5.4 |
| EC10 | | 54 | 36 | 10 | 5.5 |
| EC11 | | 65.2 | 34.8 | | 5.0 |
| EC12 | | 54.3 | 45.7 | | 6.0 |
| EC13 | | 4.3.5 | 56.5 | | 7.0 |

TABLE 3

| Fuel Emulsions | | | |
|---|---|---|---|
| Sample | Emulsifier Composition % wt | Diesel % wt | Water % wt |
| FE1 | EC1 - 2.0% | 88.0 | 10.0 |
| FE2 | EC2 - 1.6% | 88.4 | 10.0 |
| FE3 | EC3 - 1.2% | 88.8 | 10.0 |
| FE4 | EC4 - 0.7% | 89.3 | 10.0 |
| FE4a | EC4a - 0.7% | 89.3 | 10.0 |
| FE5 | EC5 - 2.0% | 88.0 | 10.0 |
| FE6 | EC6 - 2.0% | 88.0 | 10.0 |
| FE7 | EC7 - 2.0% | 88.0 | 10.0 |
| FE8 | EC8 - 2.0% | 88.0 | 10.0 |
| FE9 | EC9 - 1.0% | 89.0 | 10.0 |
| FE9a | EC9 - 2.0% | 88.0 | 10.0 |
| FE10 | EC10 - 1.0% | 89.0 | 10.0 |
| FE10a | EC10 - 2.0% | 88.0 | 10.0 |
| FE11 | EC11 - 1.0% | 89.0 | 10.0 |
| FE11a | EC11 - 2.0% | 88.0 | 10.0 |
| FE12 | EC12 - 1.0% | 89.0 | 10.0 |

TABLE 3-continued

| Fuel Emulsions | | | |
|---|---|---|---|
| Sample | Emulsifier Composition % wt | Diesel % wt | Water % wt |
| FE12a | EC12 - 2.0% | 88.0 | 10.0 |
| FE13 | EC13 - 1.0% | 89.0 | 10.0 |
| FE13a | EC13 - 2.0% | 88.0 | 10.0 |

In Table 4, the observations are as follows:

a) "cloudy"=emulsion;

b) "cream"=water rich layer at bottom of cylinder;

c) "oil"=separated diesel layer at top of cylinder; and d) "water"=separated water layer at bottom of cylinder.

As fuel is drawn from the bottom of tanks supplying engines, the presence of "water" at the bottom of the fuel emulsion is the most detrimental observation. It will be readily apparent that too high a proportion of water drawn into the engine will result in stoppage of the engine. Although the presence of "cream", ie the water-rich layer, is not particularly desired for the same reason, "cream" is still an emulsion containing diesel.

The observations in Table 4 were taken at regular intervals. The observations for Samples FE1 to FE4 were taken at 5, 7, 11, 13 and 15 days; the observations of the Samples FE4*a* to FE13*a* were taken variously at 6, 9 and 13 days, 3, 7 and 11 days, 3, 7, 11 and 18 days and 3 and 11 days. The columns for 7 and 11 days observations are the same throughout the table for ease of reference.

Samples FE1 to FE4 and FE4*a* were prepared on an equal cost basis, ie the cost of the amount of emulsifier composition in each sample is substantially the same. It is to be noted opposite Samples FE4 and FE4*a* that they maintained the water in the fuel emulsion even though they were present at a relatively low level. However, a significant amount of oil separated from the emulsion.

Comparative Samples FE11 to FE13*a* show significant water separation even after only 3 days.

TABLE 4

| Fuel Emulsion Stability Observations | | | | | | |
|---|---|---|---|---|---|---|
| Sample | HLB | 5 days | 7 days | 11 days | 13 days | 15 days |
| FE1 | 4.4 | 1 ml oil Cloudy to bottom | 1 ml oil Cloudy to bottom | 1 ml oil Cloudy to bottom | 1 ml oil Cloudy to bottom | 2 ml oil Cloudy to bottom |
| FE2 | 4.5 | <0.5 ml oil Cloudy to bottom | 0.5 ml oil Cloudy to bottom | 0.5 ml oil Cloudy to bottom | 0.5 ml oil Cloudy to bottom | 2 ml oil Cloudy to bottom |
| FE3 | 4.6 | <0.5 ml oil Cloudy to bottom | <0.5 ml oil Cloudy to bottom | <0.5 ml oil Cloudy to bottom | <0.5 ml oil Cloudy to bottom | <0.5 ml oil Cloudy to bottom |
| FE4 | 5.0 | 2 ml oil Cloudy to bottom | 3 ml oil Cloudy to bottom | 5 ml oil Cloudy to bottom | 5 ml oil Cloudy to bottom | 7.5 ml oil Cloudy to bottom |

| Sample | HLB | 6 days | 9 days | 13 days |
|---|---|---|---|---|
| FE4a | 5.0 | 1 ml oil 1 ml cream | 1.5 ml oil 1 ml cream | 1 ml oil 2 ml cream |

| Sample | HLB | 3 days | 7 days | 11 days |
|---|---|---|---|---|
| FE5 | 6.5 | Trace oil Cloudy to bottom | Trace oil Cloudy to bottom | 1 ml oil Cloudy to bottom |

TABLE 4-continued

Fuel Emulsion Stability Observations

| | | | | | |
|---|---|---|---|---|---|
| FE6 | 7.0 | Trace oil Cloudy to bottom | Trace oil Cloudy to bottom | 1 ml oil Cloudy to bottom | |
| FE7 | 7.5 | Trace oil Cloudy to bottom | Trace oil Cloudy to bottom | 1 ml oil Cloudy to bottom | |
| FE8 | 8.0 | Trace oil Cloudy to bottom | Trace oil Cloudy to bottom | 1 ml oil Cloudy to bottom | |
| Sample | HLB | 3 days | 7 days | 11 days | 18 days |
| FE9 | 5.4 | <0.5 ml oil <0.5 ml cream | 1.0 oil <0.5 ml cream | Trace oil 4 ml cream | 2 ml oil 7.5 ml cream |
| FE9a | 5.4 | <0.5 ml oil <0.5 ml cream | 1.0 oil <0.5 ml cream | 1 ml oil 1.5 ml cream | 1 ml oil 2 ml cream |
| FE10 | 5.5 | <0.5 ml oil <0.5 ml cream | 1.0 oil <0.5 ml cream | 1.5 oil <0.5 ml cream | 2 ml oil 1 ml water |
| FE10a | 5.5 | <0.5 ml oil <0.5 ml cream | 0.5 oil <0.5 ml cream | 1.0 oil <0.5 ml cream | 1 ml oil No water |
| FE11* | 5.0 | 1 ml oil 5 ml water | | 1 ml oil 5 ml water | |
| FE11a* | 5.0 | No clear oil 1 ml cream | | No clear oil 1 ml cream | |
| FE12* | 6.0 | 1 ml oil 7 ml water | | 1 ml oil 8 ml water | |
| FE12a* | 6.0 | 1 ml oil 2 ml water | | Trace oil 4 ml water | |
| FE13* | 7.0 | 1 ml oil 8 ml water | | 3 ml oil 9 ml water | |
| FE13a* | 7.0 | 1 ml oil 6 ml water | | 2.5 ml oil 8 ml water | |

*Comparative examples.

EXAMPLE 2

Comparative Method

Samples EC1 to EC4 were each mixed in a beaker with diesel in the proportions shown in Table 5. To each fuel/emulsifier composition sample CFE1 to CFE4 was added 0.25 g of demineralised water, mixing being effected by low shear stirring. The water was not dispersed in the diesel but remained as separate globules in the bottom of the beaker.

TABLE 5

Comparative Fuel/Emulsifier Compositions

| Sample | Emulsifier Composition % wt | Diesel % wt |
|---|---|---|
| CFE1 | EC1 - 2.0% | 98.0 |
| CFE2 | EC2 - 1.6% | 98.4 |
| CFE3 | EC3 - 1.2% | 98.8 |
| CFE4 | EC4 - 0.7% | 99.3 |

This Example demonstrates that, even with very small quantities of water, low shear mixing is ineffective.

EXAMPLE 3

Comparative Method

Samples CFE5 to CFE8 were prepared using quantities of EC1 to EC4 as shown in Table 6. To each of those samples was added drop wise 100 g of demineralised water, mixing being effected by high shear stirring using a Turrax stirrer on setting 1 (11,000 rpm). 20 g of each of diesel/emulsifier composition/water sample (Samples CFE5*a* to CFE8*a*) was added to 80 g of diesel; transferred to a 100 ml stoppered measuring cylinder; and the cylinder was inverted four times to mix the contents thereof.

This resulted in a final percentage by weight concentration of emulsifier composition as shown in Table 7. The observations on the samples are shown in Table 7.

There was no water layer present in any of the samples although there were significant levels of cream, ie a water rich layer, in the samples. This Example demonstrates that preparing a separate "master batch" of fuel emulsion was not as effective as mixing the ingredients in a single mixing operation as set out in Example 1.

TABLE 6

Comparative Fuel/Emulsifier Compositions

| Sample | Emulsifier Composition % wt | Diesel % wt |
|---|---|---|
| CFE5 | EC1 - 20.0% | 80.0 |
| CFE6 | EC2 - 16.0% | 84.0 |
| CFE7 | EC3 - 12.0% | 88.0 |
| CFE8 | EC4 - 7.00% | 93.0 |

TABLE 7

Comparative Fuel Emulsion Compositions

| Sample | HLB | % age concentration of emulsifier composition | 2 days | 4 days | 7 days | 21 days |
|---|---|---|---|---|---|---|
| CFE5a | 4.39 | 2.0 | 2 ml oil 1.5 ml cream | 2 ml oil 2.5 ml cream | TraceI oil* 7 ml cream | TraceI oil* 13 ml cream |
| CFE6a | 4.47 | 1.6 | 2 ml oil 1.5 ml cream | 2 ml oil 1.5 ml cream | TraceI oil* 5 ml cream | TraceI oil* 13 ml cream |
| CFE7a | 4.64 | 1.2 | 2 ml oil 1 ml cream | 2 ml oil 1 ml cream | TraceI oil* 3 ml cream | TraceI oil* 12 ml cream |
| CFE8a | 5.0 | .0.7 | 1 ml oil <0.5 ml cream | 2 ml oil <0.03 ml cream | 2.5 ml oil 1.5 ml cream | 7 ml oil 8 ml cream |

*Very difficult to estimate as progressively cloudy with no clear interface.

The invention claimed is:

1. A fuel emulsion comprises a water-in-diesel emulsion containing an emulsifier composition in an amount effective to form a stable emulsion, the emulsifier composition comprising:

(i) a polyester non-ionic surfactant having hydrophilic repeating units comprising polyoxyalkylene and hydrophobic repeating units comprising long chain hydrocarbon residues; and (ii) at least one component selected from:

a) fatty acid esters or partial esters of polyhydric alcohols;

b) alkoxylated fatty acid esters or partial esters of polyhydric alcohols; and c) alkoxylated primary alcohols;

wherein:

1) the polyester non-ionic surfactant has a hydrophile/lipophile balance value of between 4 and 8, and 2) the emulsifier composition has an hydrophile/lipophile balance value of at least 4 and not more than 8;

3) the fuel emulsion is stable for at least 10,000 minutes.

2. A fuel emulsion according to claim 1 which contains at least 70% by weight diesel and up to 25% by weight of water, the weight percentages being based on the total weight of the emulsion.

3. A fuel emulsion according to claim 1 comprising an amount of emulsifier composition in the range 0.1% to 4% by weight of the total weight of the composition.

4. A fuel emulsion according to claim 1 in which the emulsifier composition has an hydrophile/lipophile balance value of at least 5 and not more than 8.

5. A fuel emulsion according to claim 1 which comprises not more than 50% by weight, based on the total weight of the emulsifier composition, of the polyester non-ionic surfactant in combination with at least one of components a), b) and c).

6. A fuel emulsion according to claim 1 which comprises the polyester non-ionic surfactant in combination with at least two of components a), b) and c).

7. A fuel emulsion according to claim 1 which comprises the polyester non-ionic surfactant in combination with components a) and b).

8. A fuel emulsion according to claim 1 in which component a) is a reaction product of one or more polyhydric alcohols and one or more fatty acids.

9. A fuel emulsion according to claim 8 in which the polyhydric alcohol comprises alcohols having at least three hydroxyl groups.

10. A fuel emulsion according to claim 8 in which the polyhydric alcohol is selected from glycerol and sorbitol.

11. A fuel emulsion according to claim 8 in which the fatty acid comprises a $C_{12}$ to $C_{24}$, straight or branched chain, saturated or unsaturated acid.

12. A fuel emulsion according to claim 8 in which the fatty acid comprises a $C_{16}$ to $C_{20}$ straight chain acid.

13. A fuel emulsion according to claim 8 in which the fatty acid is selected from stearic acid or oleic acid.

14. A fuel emulsion according to claim 1 in which component b) is a reaction product of at least one component a) with an alkylene oxide.

15. A fuel emulsion according to claim 1 in which component b) is a reaction product of at least one component a) with not more than 50 moles of an alkylene oxide.

16. A fuel emulsion according to claim 1 in which component c) is a reaction product of $C_7$-$C_{20}$ primary alcohols or mixtures thereof with an alkylene oxide.

17. A fuel emulsion according to claim 1 in which component c) is a reaction product of $C_7$-$C_{20}$ primary alcohols or mixtures thereof with not more than 50 moles of an alkylene oxide.

18. A fuel emulsion according to claim 1 comprising a primary alcohol.

19. A fuel emulsion according to claim 18 comprising a primary alcohol selected from $C_5$ to $C_{15}$ primary alcohols.

20. A fuel emulsion according to claim 18 in which the primary alcohol comprises up to 5% by weight of the emulsifier composition.

21. An emulsifier composition for use in fuel emulsions, which composition comprises:

(i) a polyester non-ionic surfactant having hydrophilic repeating units comprising polyoxyalkylene and hydrophobic repeating units comprising long chain hydrocarbon residues; and (ii) at least one component selected from:

a) fatty acid esters or partial esters of polyhydric alcohols;

b) alkoxylated fatty acid esters or partial esters of polyhydric alcohols; and c) alkoxylated primary alcohols;

wherein:

1) the polyester non-ionic surfactant has a hydrophile/lipophile balance value of between 4 and 8, and 2) the emulsifier composition has an hydrophile/lipophile balance value of at least 4 and not more than 8;

3) the fuel emulsion is stable for at least 10,000 minutes.

22. An emulsifier composition according to claim 21 having an hydrophile/lipophile balance value of at least 5 and not more than 8.

23. An emulsifier composition according to claim 21 which comprises not more than 50% by weight, based on the total weight of the emulsifier composition of the polyester non-ionic surfactant in combination with at least one of components a), b) and c).

24. An emulsifier composition according to claim 21 which comprises the polyester non-ionic surfactant in combination with at least two of components a), b) and c).

25. An emulsifier composition according to claim 21 which comprises the polyester non-ionic surfactant in combination with components a) and b).

26. An emulsifier composition according to claim 21 in which component a) is a reaction product of one or more polyhydric alcohols and one or more fatty acids.

27. An emulsifier composition according to claim 26 in which the polyhydric alcohol comprises alcohols having at least three hydroxyl groups.

28. An emulsifier composition according to claim 26 in which the polyhydric alcohol is selected from glycerol and sorbitol.

29. An emulsifier composition according to claim 26 in which the fatty acid comprises a $C_{12}$ to $C_{24}$, straight or branched chain, saturated or unsaturated acid.

30. An emulsifier composition according to claim 26 in which the fatty acid comprises a $C_{16}$ to $C_{20}$ straight chain acid.

31. An emulsifier composition according to claim 26 in which the fatty acid is selected from stearic acid or oleic acid.

32. An emulsifier composition according to claim 21 in which component b) is a reaction product of at least one component a) with an alkylene oxide.

33. An emulsifier composition according to claim 32 in which component b) is a reaction product of at least one component a) with not more than 50 moles of an alkylene oxide.

34. An emulsifier composition according to claim 21 in which component c) is a reaction product of $C_7$-$C_{20}$ primary alcohols or mixtures thereof with an alkylene oxide.

35. An emulsifier composition according to claim 34 in which component c) is a reaction product of $C_7$-$C_{20}$ primary alcohols or mixtures thereof with not more than 50 moles of an alkylene oxide.

36. An emulsifier composition according to claim 21 comprising a primary alcohol.

37. An emulsifier composition according to claim 36 comprising a primary alcohol selected from $C_7$-$C_{20}$ primary alcohols.

38. An emulsifier composition according to claim 36 in which the primary alcohol comprises up to 5% by weight of the emulsifier composition.

39. A method of making a fuel emulsion which comprises a water-in-diesel emulsion containing an emulsifier composition in an amount effective to form a stable emulsion, the emulsifier composition comprising:

(i) a polyester non-ionic surfactant having hydrophilic repeating units comprising polyoxyalkylene and hydrophobic repeating units comprising long chain hydrocarbon residues; and (ii) at least one component selected from:

a) fatty acid esters or partial esters of polyhydric alcohols;

b) alkoxylated fatty acid esters or partial esters of polyhydric alcohols; and c) alkoxylated primary alcohols;

wherein:

1) the polyester non-ionic surfactant has a hydrophile/lipophile balance value of between 4 and 8, and the emulsifier composition has an hydrophile/lipophile balance value of at least 4 and not more than 8;

2) said method comprises, in a single mixing operation, introducing diesel and the emulsifier composition and then water into a mixing vessel whilst subjecting the mixture to high shear mixing at a speed and for a period sufficient to create the emulsion; and 3) the fuel emulsion is stable for at least 10,000 minutes.

* * * * *